US008556252B2

(12) United States Patent
Merkli

(10) Patent No.: US 8,556,252 B2
(45) Date of Patent: Oct. 15, 2013

(54) DEVICE AND METHOD TO SUPPLY PRINT PRODUCTS TO A PROCESSING SECTION

(75) Inventor: Peter Merkli, Oftringen (CH)

(73) Assignee: Mueller Martini Holding AG, Hergiswil (CH)

( * ) Notice: Subject to any disclaimer, the term of this patent is extended or adjusted under 35 U.S.C. 154(b) by 0 days.

(21) Appl. No.: 12/786,011

(22) Filed: May 24, 2010

(65) Prior Publication Data

US 2010/0295236 A1 Nov. 25, 2010

(30) Foreign Application Priority Data

May 22, 2009 (EP) ..... 09405083

(51) Int. Cl.
*B65H 3/08* (2006.01)

(52) U.S. Cl.
USPC ..... 271/101; 271/12; 271/13; 271/99; 271/100

(58) Field of Classification Search
USPC ..... 271/13, 101, 100
See application file for complete search history.

(56) References Cited

U.S. PATENT DOCUMENTS

| | | | | |
|---|---|---|---|---|
| 3,071,369 | A * | 1/1963 | Ambrogi | 270/52.16 |
| 3,166,311 | A * | 1/1965 | Rabinow et al. | 271/12 |
| 3,385,594 | A * | 5/1968 | Preisig | 271/12 |
| 3,973,767 | A * | 8/1976 | Kramer | 271/12 |
| 4,830,352 | A * | 5/1989 | Birtwhistle | 270/58.29 |
| 6,332,607 | B1 * | 12/2001 | Van Der Werff | 271/101 |
| 6,698,749 | B2 * | 3/2004 | Muller | 271/99 |
| 6,702,276 | B2 * | 3/2004 | Muller | 271/101 |
| 2005/0073083 | A1 * | 4/2005 | Burk et al. | 270/52.18 |
| 2007/0023991 | A1 * | 2/2007 | Walther | 271/37 |

FOREIGN PATENT DOCUMENTS

| | | | |
|---|---|---|---|
| DE | 40 09 414 | A1 | 10/1990 |
| DE | 10 2004 030254 | B3 | 9/2005 |
| EP | 1 520 817 | A1 | 4/2005 |
| EP | 1 718 013 | A1 | 2/2006 |
| EP | 1 748 013 | A | 1/2007 |
| WO | WO-2005/094164 | A2 | 10/2005 |

OTHER PUBLICATIONS

European Search Report Issued in Priority Application No. EP 09405083.8 on Sep. 11, 2009.

* cited by examiner

*Primary Examiner* — Michael McCullough
*Assistant Examiner* — Howard Sanders
(74) *Attorney, Agent, or Firm* — Venable LLP; Robert Kinberg

(57) ABSTRACT

A method and device to supply a processing section adjoining the device with print products withdrawn from a stack of print products in a feeder. The device including a magazine to contain the stack of print products and a separating device to separate a lowest print product from the stack along an edge region of the lowest print product formed by a sheet edge or a last fold. The device further includes a rear holder that is displaceable in coordination with the separating device to support the stack remaining during a cycle of withdrawing the lowest print product from the stack. A withdrawing device withdraws the lowest print product from an underside of the stack and includes a gripper to grip a front end of the lowest print product in the withdrawing direction while operating with timing of the separating device and the rear holder in the cycle.

10 Claims, 6 Drawing Sheets

DEVICE AND METHOD TO SUPPLY PRINT PRODUCTS TO A PROCESSING SECTION

CROSS-REFERENCE TO RELATED APPLICATION

This application claims the priority of the European Patent Application No. 09405083.8, filed on May 22, 2009, the subject matter of which is incorporated herein by reference in its entirety.

BACKGROUND

The subject matter of the application relates to a method for supplying a processing section with print products that are withdrawn individually from the underside of a stack of print products, arranged one above the other, and are supplied to a processing section, wherein the print products are separated from the remaining stack of print products along the last fold or an edge region formed by a sheet edge before being withdrawn. The print product stack is supported at least during the withdrawing of a print product by a rear holder that can be advanced. Methods of the aforementioned type are known for the manufacture of books, magazines or other products, for example for the purpose of gathering the print products into loose book blocks.

The International Patent Publication No. WO 2005/094164 discloses a method and an arrangement for supplying the respective print products in an overlapping flow and transverse to the movement direction of a conveying channel to a gathering device, composed of circulating carriers. The respectively first print product is gripped along the folded edges by a gripper of a parallel circulating feeding device, is withdrawn from the overlapping flow without being guided on the side, and is deposited exclusively in the conveying channel.

European Patent document EP 1 520 817 A1, with a prior publication date, describes a method and a device where print products are gathered into unbound book blocks along a conveying section which is supplied by several feeders with print products. The print products are respectively lifted up along an edge region on the front of a print product stack and are withdrawn with the aid of a conveying element from the print product stack.

European Patent document EP-A-1 718 013 discloses a device for gathering print products. The device comprises a delivery station arranged in series along a gathering conveyor and includes a magazine for accommodating respectively one stack of identical print products. Separating devices for the feeding stations grip an exposed edge region of the respectively lowest print product and tilt this product, so that it can be gripped by parallel-moving grippers that are attached to a driven, endless chain and function to transfer the print products to a gathering conveyor provided with uniformly spaced apart carriers.

SUMMARY

It is an object of the present application to specify a device and method which allows feeding print products to a processing section in a more careful and reliable manner and with simpler devices than has been possible so far.

The above and other objects are accomplished according to one aspect of the invention, wherein there is provided a method to supply a processing section with print products, comprising: separating a lowest print product along an edge region formed by a sheet edge or a fold from a stack of print products arranged one above the other; withdrawing the lowest print product in a withdrawing direction from an underside of the stack; and supporting the stack at least during the withdrawing with a displaceable rear holder, wherein the withdrawing includes gripping the lowest print product in the withdrawing direction along a front end of the edge region previously separated from the stack, and guiding the lowest print product with the sheet edge or the fold in the withdrawing direction along the rear holder from the stack; and supplying the lowest print product to the processing section.

According to a further aspect of the invention, there is provided a device to supply a processing section adjoining the device with print products withdrawn from a stack of print products in a feeder, comprising: a magazine to contain the stack of print products, the print products being arranged one above the other; a separating device to separate a lowest print product from the stack along an edge region of the lowest print product formed by a sheet edge or a last fold; a rear holder that is displaceable in coordination with the separating device to support the stack remaining during a cycle of withdrawing the lowest print product from the stack; and a withdrawing device to withdraw the lowest print product from an underside of the stack including an opening and closing gripper operatively coupled to the processing section, the gripper driven to move back and forth parallel to the withdrawing direction and to grip a front end of the lowest print product in the withdrawing direction while operating with timing of the separating device and the rear holder in the cycle.

According to an embodiment of the invention, the print products are gripped along the front end of the separated edge region, as seen in withdrawing direction, and are transferred from the print product stack to the processing section while guided with the last fold or a sheet edge in withdrawing direction along the rear holder. No deflections of the print products along the path toward the processing section are thus required, and the print products are not subjected to any particular stresses. In addition, a high processing speed can be achieved with this method.

Further, the print products to be withdrawn may be transferred to the processing section while at least partially withdrawn from underneath the print product stack, so that no intermediate conveying is necessary.

As a result of the method according to the invention, the print products may be pulled flat from the stack of print products.

In a further embodiment, there is provided a device for supplying a downstream arranged processing section or station with print products which are pulled with the aid of a withdrawing device from underneath a stack of print products, arranged one above the other, inside a magazine. Also provided is a separating device for separating or lifting an edge region, primarily formed by a last fold or a sheet edge, of the lowest print product in the stack. A rear holder is advanced during each cycle to the separating device to support the print product stack or the remaining print product stack, at least during the withdrawing of the print products. These simple structural devices may be used to separate the stacked print products and to withdraw and transport these products for a more reliable high operational output.

According to an embodiment, a withdrawing device includes an opening and closing gripper, driven back and forth parallel to a withdrawing direction with the operating cycle of the separating device and the rear holder. The gripper grips the separated edge region or the gripping edge on the front, as seen in the withdrawing direction and is operatively connected to the processing section.

The print products may thus be processed in a careful manner. The rear holder may be arranged to advance transverse or at a right angle to the withdrawing direction for the print products, such that the last folding edge or the sheet edge that delimits the edge region extends parallel to the conveying direction and may be used as reference edge.

The rear holder, which is activated to support the stack or the remaining stack of print products, may comprise a guide arrangement to guide the print products to be withdrawn. In withdrawing direction, the guide arrangement may extend at least partially over the magazine width and acts upon the edge region of a print product that is separated. This guide arrangement may provide a higher stability and accuracy of orientation for the print products along the conveying path.

The guide arrangement may comprise a guide member extending approximately parallel at least on the underside of the tilted edge region of a print product. The free end of this guide member may contain a guide component that is connected to the rear holder, so that a position-correct transfer of the print products may take place.

For a simple and stable attachment, the guide component may be connected to the rear holder via a connecting element that functions as guide member above the separated edge region of a print product. Accordingly, a channel-type guide path is formed together with the guide member.

At least one of the elements forming the guide arrangement may be embodied as a solid wall to enhance the guiding characteristics and the behavior of the print products along the conveying path.

The guide component may be arranged at an angle to the guide member and form a guiding surface along which the last fold or sheet edge of the print products can glide.

A compact design of the device may be achieved if the separating device is attached below the stack of print products, respectively the magazine, such that it may pivot around a horizontal axis. The separating device may be embodied for example as a pivoting suction head that is arranged parallel to the withdrawing device.

BRIEF DESCRIPTION OF THE DRAWINGS

The subject matter of the application will be more readily understood from the following detailed description when read in conjunction with the accompanying drawings, in which.

DETAILED DESCRIPTION

Figure 1:
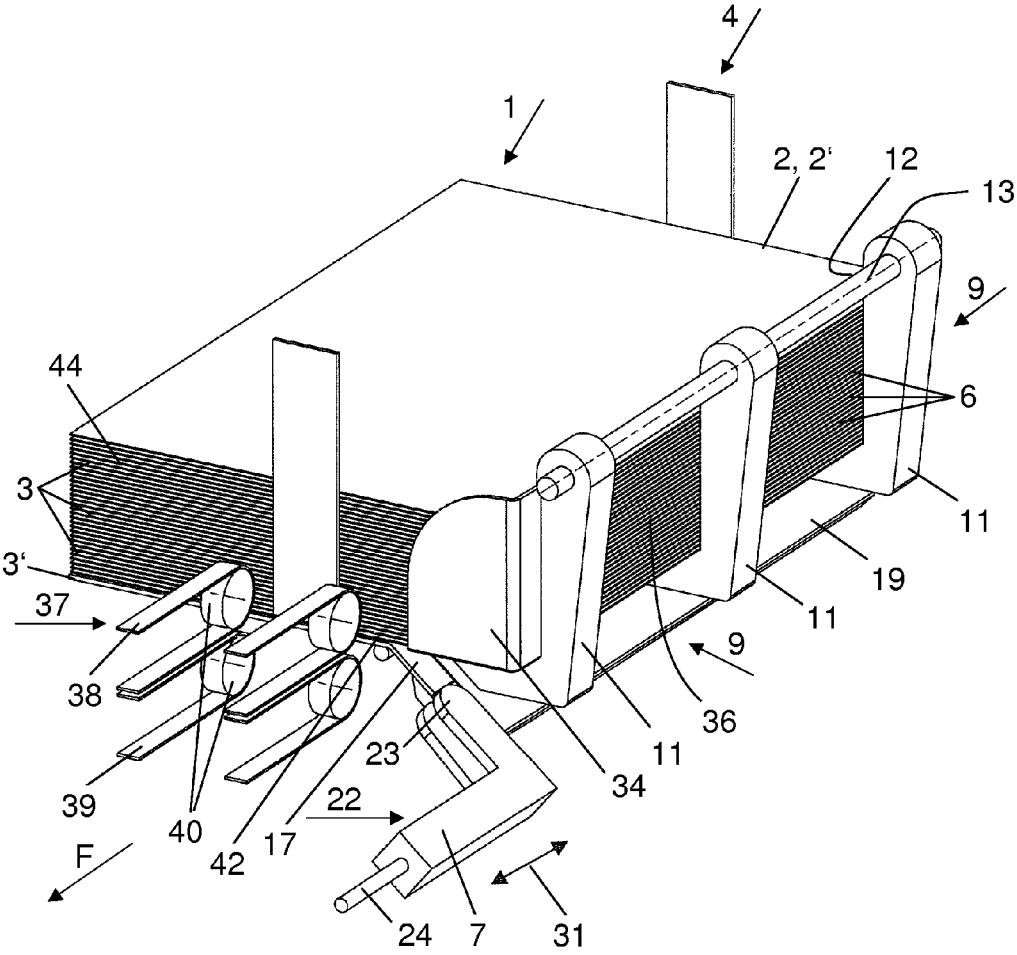
FIG. 1 is a schematic, three-dimensional representation of the device according to the invention.

FIG. 1 shows a device 1 to supply a processing section (not visible in FIG. 1) with print products 3, 3', in a processing direction. The print products are respectively withdrawn from the underside of a stack 2, 2' of print products 3,3', arranged one above the other inside a magazine 4, and are supplied to the processing section for the further processing.

According to one embodiment, during the further processing, the print products 3, 3' are processed into books, magazines, brochures and the like. Prior to withdrawing the individual print products 3, 3' from the stack 2, the respective print products are separated and lifted up by an edge region from the remaining stack of print products 2', primarily by the last fold or in the case of an individual sheet by an edge region of a sheet edge that is also called a edge region 6. In the process, the print product stack 2 and the remaining stack 2' are supported by a rear holder 9 which operates with the timing of a separating device 5.

During the transfer of the respectively lowest print product 3' to the processing section, these products are gripped by the front end 8 of the edge region 6, as seen in withdrawing direction F, respectively by the tilted edge region 6 that is separated from the print product stack 2'. The lowest print product 3' is then supplied to the processing section with the last fold or the sheet edge moving along the advanced rear holder 9. The transfer to the processing section which adjoins the device 1 may be achieved even before the print product 3' has left the device 1. The print product is withdrawn and/or transferred while positioned approximately horizontal or flat, meaning approximately no deflections or movement to the upright position takes place which could hinder the transfer. The connection between the device and the processing section must therefore be coplanar.

To realize the method-technical steps, a device is furthermore provided to supply a processing section, adjoining this device, with print products 3' which are withdrawn with the aid of a withdrawing device 22 from the underside of a stack 2 of print products 3, 3', arranged one above the other inside a magazine 4.

Prior to that, the individual print products 3, 3' are pulled with the aid of the separating device 5 downward on the underside of the print product stack 2 or the remaining stack 2', in the edge region, along the edge region 6 facing the rear holder 9. The rear holder 9 is pulled back immediately prior (see FIG. 3). The edge region 6 is primarily a fold consisting of multiple print product 3' pages, but may also be located along an edge of an individual sheet or a plan sheet. The separating device 5 and the rear holder 9 are controlled with a timed sequence. Accordingly, the edge region 6 is lifted off while the rear holder 9 is pulled back and the print products 3' are pulled from under the stack 2' while the rear holder 9 is in an advanced position.

The withdrawing device 22 includes a gripper 7, which is driven back and forth in linear direction (double arrow 31 in FIG. 1), either pneumatically or electro-mechanically, with the aid of a controlled drive (not shown) and parallel to the withdrawing direction F. The gripper comprises two gripper jaws 23 for opening and closing the gripper 7. The opening and closing may be realized pneumatically, electro-mechanically or mechanically and the back and forth movement occurs along a guide 24. When withdrawing a print product 3' from a print product stack 2, the print product 3' is separated along the edge region 6 while the rear holder 9 is in the moved-back position.

Immediately thereafter, the rear holder 9 is pivoted under the remaining print product stack 2'. The closing gripper 7 in a starting position for the withdrawal clamps grips the separated print product 3' along the front end 8 of the edge region, respectively the edge region 6 (corner region of the print product), as seen in withdrawing direction F. The gripper 7 pulls the print product from the magazine 4 in order to transfer this product to a conveyor 37 that is assigned to the processing section.

Figure 2:
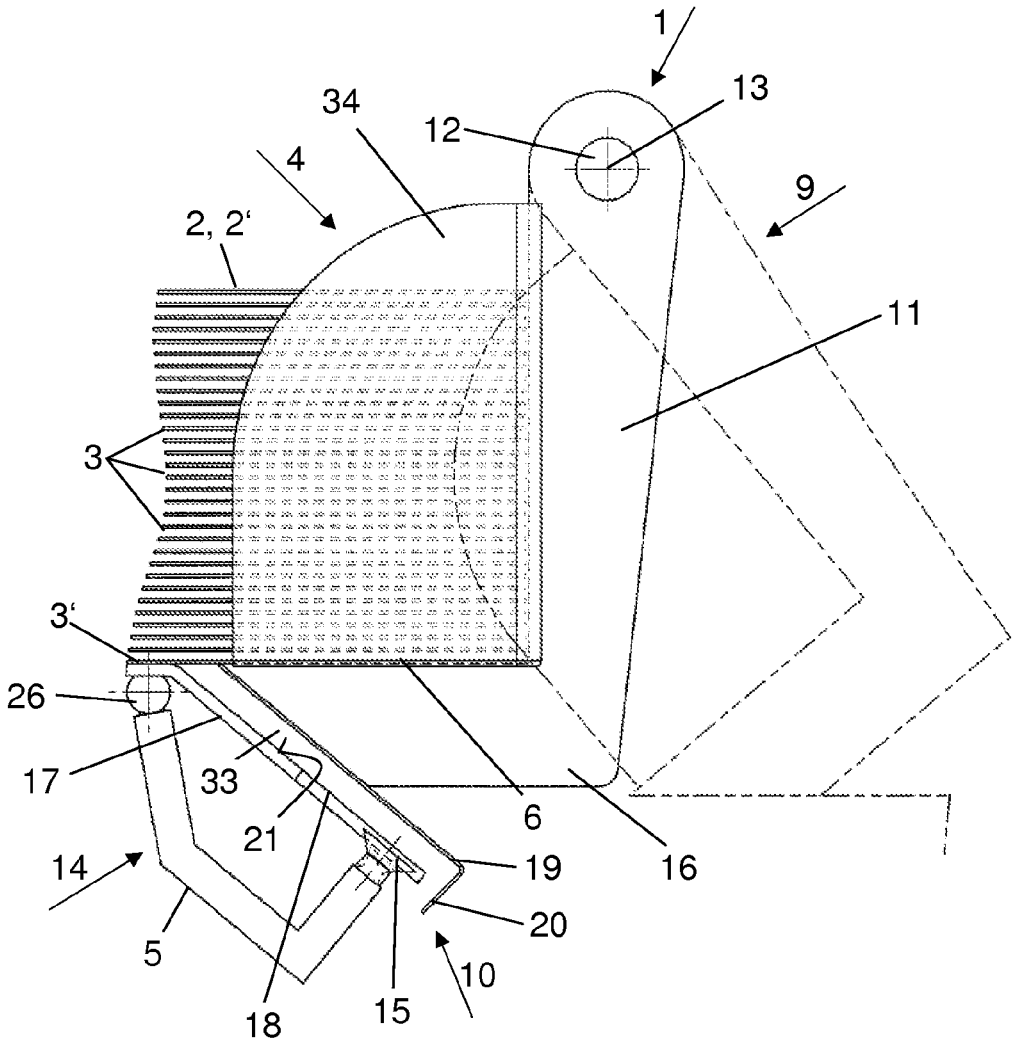
FIG. 2 is a partial view of the device shown in FIG. 1, wherein the rear holder is advanced toward the stack.
Figure 3:
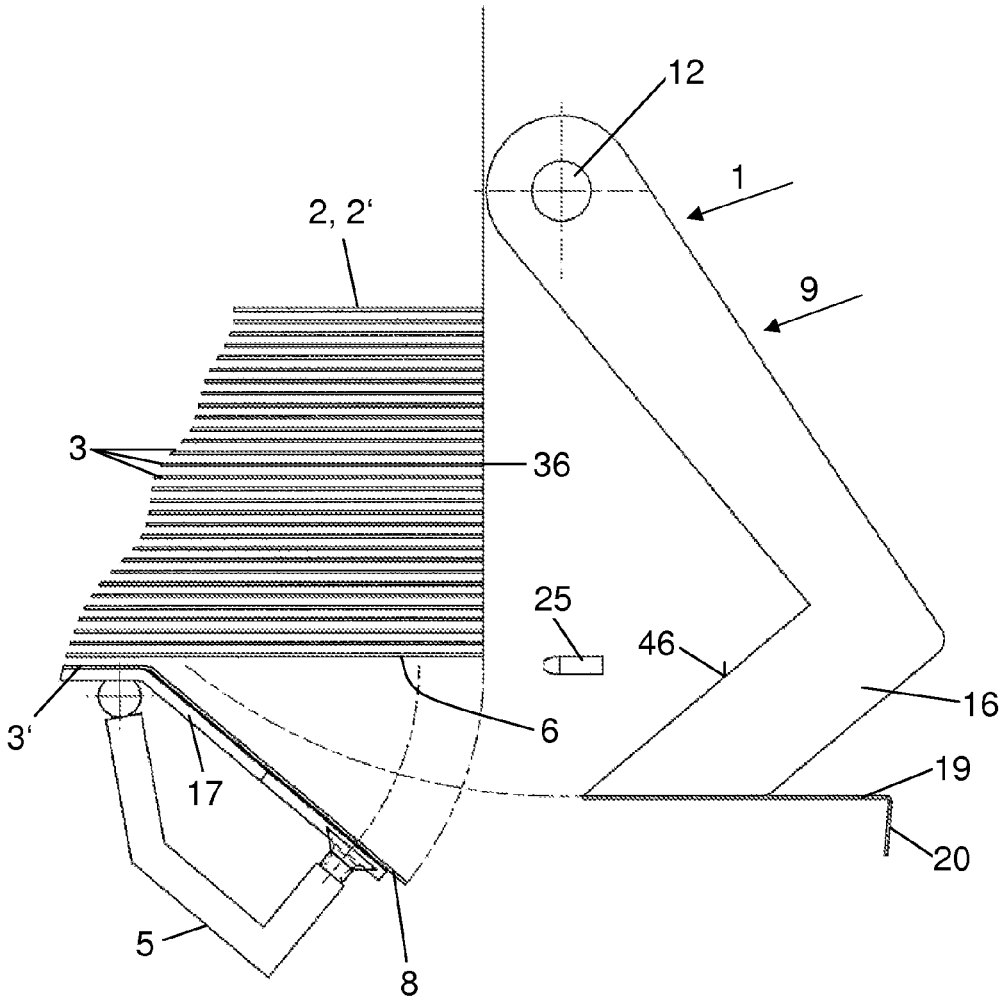
FIG. 3 is a partial view of the device illustrated in FIG. 1, wherein the gripping edge or edge region is tilted and the rear holder is in the pulled-back position.

During the withdrawing operation, the print product 3' is moved, secured against twisting, along a guide arrangement 10 until it leaves the magazine 4. The leading edge 42, as seen in conveying direction F, of the withdrawn print product 3' is moved to the processing section, clamped in between the two conveying belts 38, 39 which circulate side-by-side in pairs and form the conveyor 37. Deflection rollers 40 are used for the required reversal of the conveying belts 38, 39. The rear holder 9 may be advanced with the aid of a pivoting movement, as indicated in FIGS. 2 and 3. The rear holder 9 may comprise three lever elements 11, distributed over the width of the print product stack, which are attached to a shaft 12, to pivot around a horizontal axis 13 that extends parallel to the withdrawing direction F.

The guide arrangement 10, arranged to extend at least partially across the width of the print product stack, comprises a guide member 17 that drops down at an angle under the print product stack 2 under the rear holder 9, in the edge region 6 of the print products 3, 3'. The angle position approximately corresponds to a tilt angle of the edge region 6. The guide member 17 transitions from being approximately flush to the print product stack with its upper edge to an obtuse angle to the support surface for the print product stack. The guide member 17 includes a recess 18 through which the separating device 5 extends and grips the lowest print product 3' in order to pull the print product 3' toward the guide member 17 (see FIG. 3).

The separating device 5 includes a suction head 15, attached to a pivoting arm 14, which is connected to a controlled vacuum source. As soon as the edge region 6 is positioned opposite the guide member 17, the rear holder 9 advances to the operating position where it prevents the edge region from moving back toward the remaining print product stack 2'. For this purpose, a guide element 19 may be attached to the angled pivoting arm end 16 which is pivoted under the remaining print product stack 2'. Insofar as the separating device 5 includes several pivoting arms 14 and suction heads 15, distributed over the print product stack 2, the guide element 19 extends across the width of the print product stack. However, if the separating device 5 comprises only one pivoting arm 14 with suction head 15 which exclusively acts upon the front end 8 of the edge region 6, the guide element 19 may only extend over a portion of the width of the print product stack, so that the rear holder 9 does not collide with the print product 3' to be withdrawn while the device 9 is advanced.

To prevent the print product 3' from being displaced or rotated during the withdrawal and to ensure that the print product maintains the position it occupies in the print product stack 2, the fold edge or the edge region 6, glides along a guide component 20 which extends along the length of the guide arrangement 10. This guide component 20 operatively arranged with the guide member 17 and connected to the rear holder 9. The elements 17, 20 and the guide element 19 together form the guide arrangement 10. With the rear holder 9 pulled back, the elements 17, 20 and the guide element 19 form a narrow conveying channel 33 for guiding the print products 3' to be withdrawn. The guide members or the guide elements of the guide arrangement 10 in this case may either be solid or discontinuous guide surfaces, as long as these are suitable for the guidance.

Figure 6:
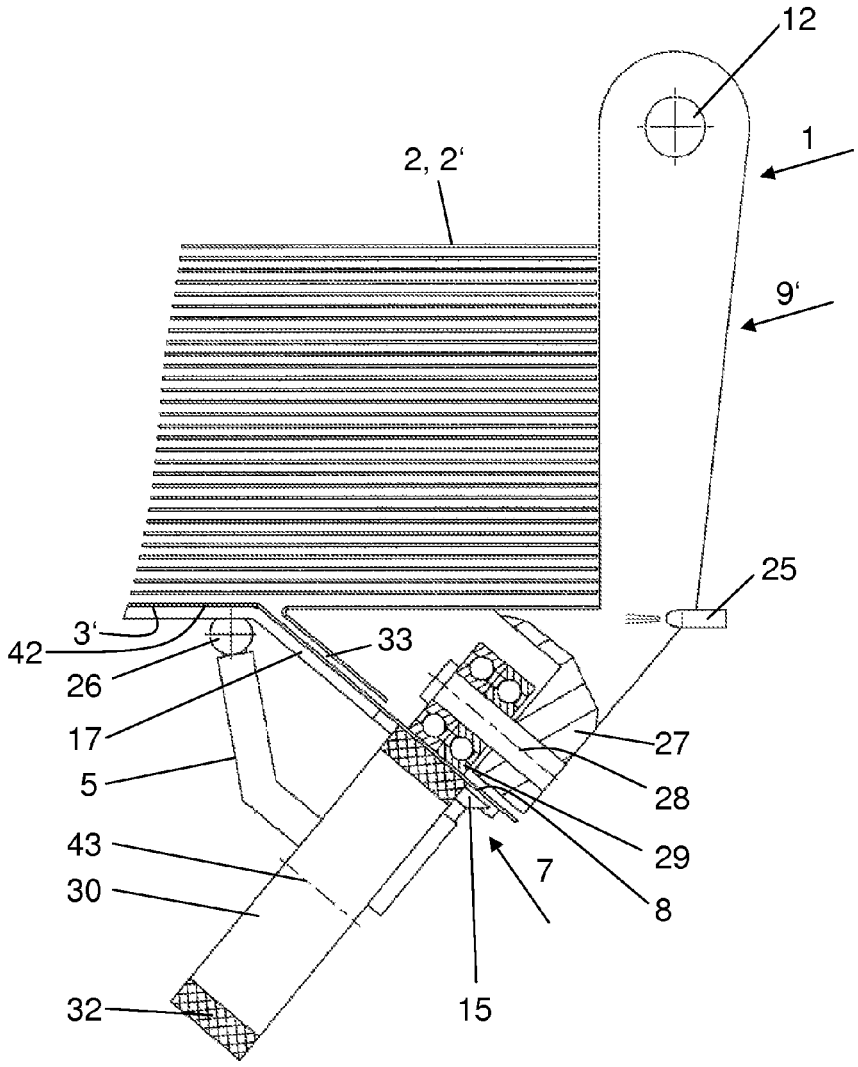
FIG. 6 is an alternative embodiment of a suction device.

According to the modified embodiment shown in FIG. 6, a gripper 7 may be used for gripping the print product 3' along the front end 8 of the edge region 6. The gripper 7 is provided on a rear holder 9' with a roll 29 which is positioned rotating with the aid of an axis 28 on a bearing part 27 of the rear holder 9'. The roll 29 cooperates with a dab roll or printer's ball 30 which can be rotated around an axis 43. The dab roll 30 may be positioned locally fixed on a holder, not shown herein. The dab roll 30 may be driven continuously with a drive that is not shown herein. The print product 3' is respectively clamped in along the front end 8 of the edge region 6 between the roll 29 and the dab roll 30 and is pulled in a direction out of the page away from the print product stack 2. The force used to withdraw the print product 3' is effective as long as the gripping device 32 cooperates with the roll 29. Accordingly, the gripping device 32 extends in circumferential direction and determines the lift and/or the distance for withdrawing the print product 3' from the print product stack 2, thereby permitting a continuous rotational movement of the dab rolls 30. The gripper 7 shown in FIG. 6 may permit a vibration-free withdrawal of a print product 3'.

However, the gripper 7 may also be a different suitable gripping device which may make it possible to grip or clamp in the front end 8 of the edge region 6. It may also make it possible to withdraw the print product 3' for a short distance from the print product stack 2, so that the print product 3' may immediately be picked up by the conveyor 37. To remove a print product 3' from the stack of print products 2, the rear holder 9' may be pivoted by the shaft 12 to the position shown in FIG. 3. Shaft 12 is also shown in FIGS. 3 and 6. An inside surface 46, which previously supported the print product stack 2, 2', is now clear as can be seen in FIG. 3. The same applies correspondingly to the underside 35 of the print product 3' to be withdrawn, shown in FIG. 4, as well as to a front 36 of the print product stack 2 which extends in the withdrawing direction F. The guide element 19 is also pivoted out, so that the above mentioned conveying channel 33 no longer exists. The guide member 17 only may still be in the original position and form a top surface 21 that also slants downward at an angle.

Figure 4:
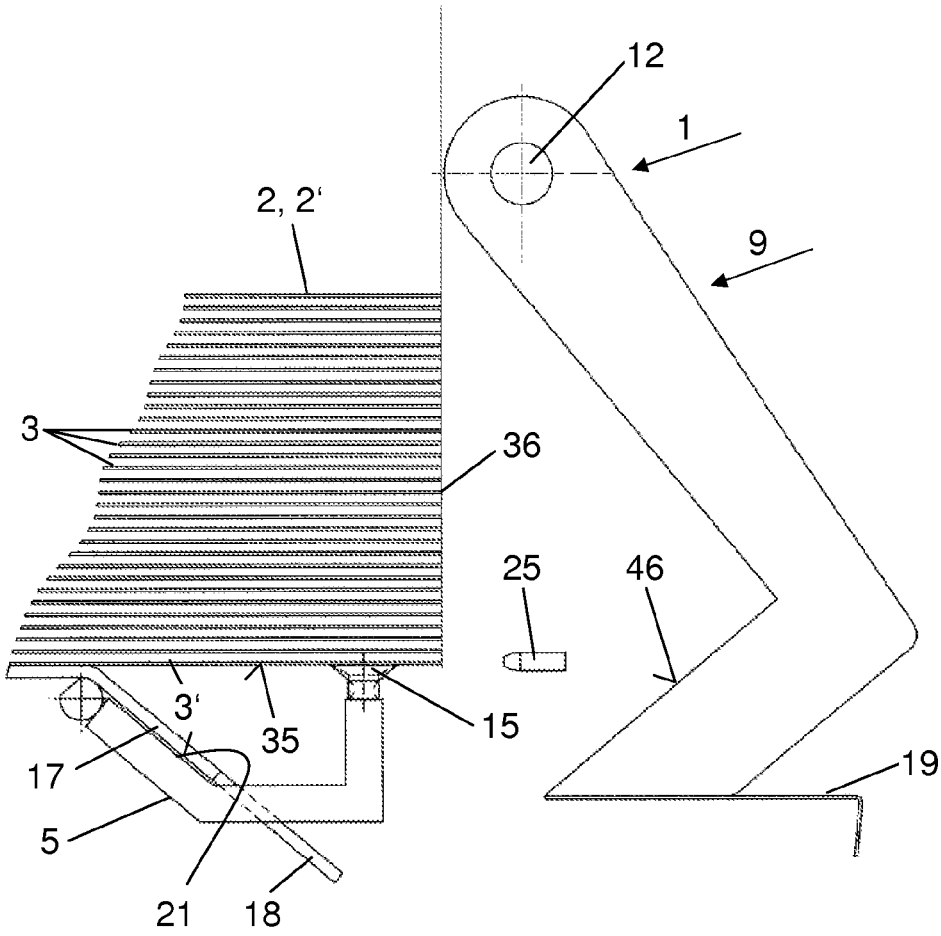
FIG. 4 is a further partial view of the device according to FIG. 1, during the gripping or clamping in of the lowest print product in a print product stack.

In a following step, the suction heads 15 may be pivoted upward to the position shown in FIG. 4 in which they fit against the underside 35 of the print product 3'. A vacuum is then generated in the suction heads 15, so that the print product 3' is pulled toward the suction heads 15.

Figure 5:
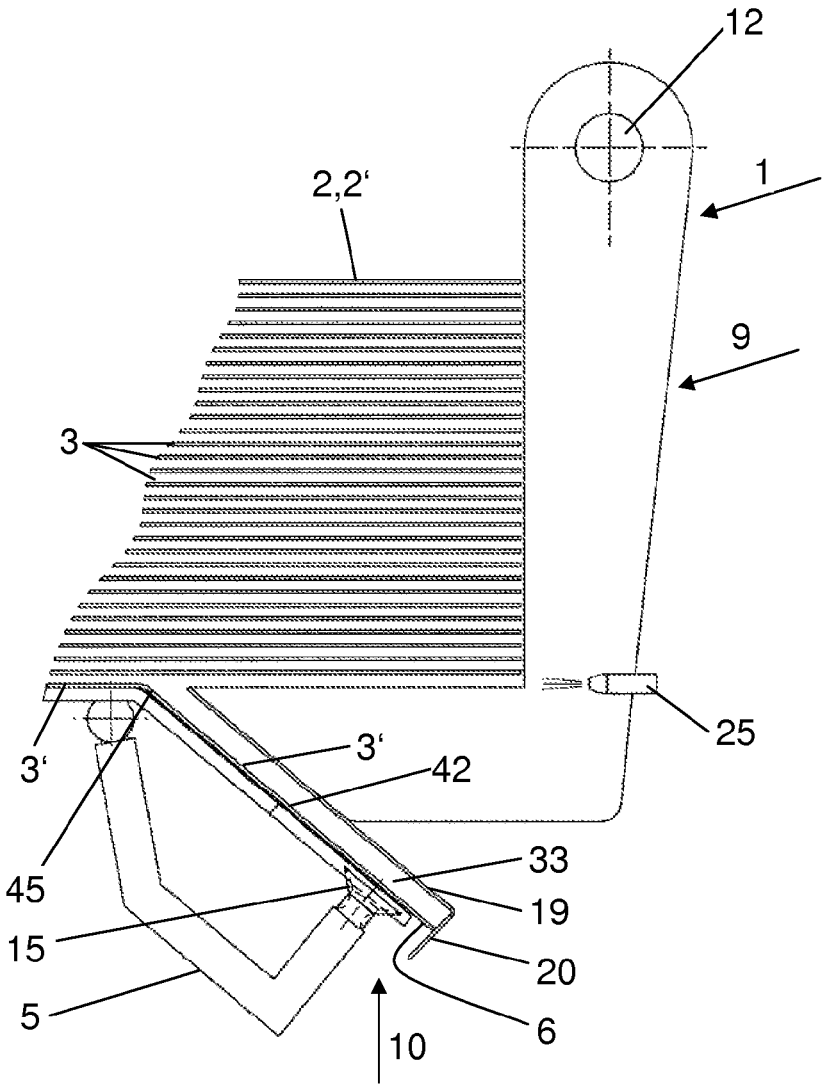
FIG. 5 is a partial view of the device visible in FIG. 1, which includes an alternative guide arrangement, showing the edge region separated and the rear holder advanced.

In a subsequent step, the separating device 5 may be pivoted downward into the position shown in FIG. 5 and, essentially at the same time, the rear holder 9 may be moved to the position that is also shown in FIG. 5, thereby forming once more the conveying channel 33. Owing to the adherence of the suction heads 15 to the underside 35 of the print product 3', the edge region 6 of this print product is moved downward and toward the surface 21. In the process, a bend 45 forms in the print product 3' and extends in withdrawing direction over the total length of the print product 3'. Below this bend 45, the edge region 6 is located inside the conveying channel 33, wherein this edge region 6 substantially extends up to the guide component 20, as shown in FIG. 5. Blast nozzles 25 can be used to blow air in the direction of the bend 45, so that an air cushion forms between the print product 3' and the above-positioned print product 3, thereby reducing the friction between these two lowest sheets during the withdrawing.

To ensure that during the withdrawing of a print product 3', the above-positioned print products 3 does not change its position, a stop element 34 may be attached to the rear holder 9 which acts in withdrawing direction F upon the front side 44 of the stack. When the rear holder 9 is advanced, meaning during the withdrawing of the print products 3', the stop element 34 is respectively in a stop position where it acts to hold back the print product stack 2'. The stop element 34 is non-functional when the rear holder 9 is in the pulled back position and the separating device 5 is carrying out a separating operation.

It will be understood that the above description of the present invention is susceptible to various modifications, changes and adaptations, and that the same are intended to be comprehended within the meaning and range of equivalents of the appended claims.

What is claimed is:

1. A method to supply print products for further processing, comprising:

separating an edge region of a lowest print product away from an underside of a stack of print products arranged one above the other using a separating device, wherein the edge region comprises a sheet edge or a fold of the lowest print product;

gripping the lowest print product previously separated from the stack at a front end of the edge region;

withdrawing the lowest print product in a withdrawing direction;

during the withdrawing supporting the stack with a rear holder that is displaceable in coordination with the separating device and guiding the edge region of the print product along and against a guide component that projects from the rear holder and presents a guide surface extending in the withdrawing direction; and supplying the withdrawn lowest print product to a conveyor for further processing.

2. The method according to claim 1, wherein the supplying further comprises transferring the lowest print product to the conveyor for further processing while the lowest print product is at least partially withdrawn from the stack.

3. The method according to claim 2, further comprising withdrawing the lowest print product in a direction that is coplanar with the underside of the stack.

4. A device to supply print products withdrawn in a withdrawing direction from a stack of print products in a feeder for further processing, comprising:

a magazine to contain the stack of print products, the print products being arranged one above the other;

a separating device to separate an edge region of a lowest print product away from an underside of the stack of print products by tilting the edge region, wherein the edge region comprises a sheet edge or a fold of the lowest print product;

a rear holder that is displaceable in coordination with the separating device to support the stack remaining during a cycle of withdrawing the lowest print product from the stack;

a guide arrangement to guide the lowest print product away from the stack during a withdrawing of the lowest print product, wherein the guide arrangement includes a guide member having a free end and extending downward at an angle and approximately parallel to the withdrawing direction at least along the underside of the tilted edge region of the print product, and extending over at least a portion of the width of the stack of print products, the guide arrangement further including a guide component connected to and projecting from the rear holder, the guide component presenting a guide surface extending adjacent the free end of the guide member in the withdrawing direction to guide the edge region of the lowest print product in the withdrawing direction; and a withdrawing device to withdraw the lowest print product from the underside of the stack and including an opening and closing gripper driven to move back and forth parallel to the withdrawing direction and to grip the lowest print product at a front end of the separated edge region while operating with timing of the separating device and the rear holder in the cycle.

5. The device according to claim 4, wherein the rear holder supports the edge region and is advanceable transverse to the withdrawing direction.

6. The device according to claim 4, further comprising a connecting element to couple the guide component with the rear holder, the connecting element acting as a guide element for the separated edge region.

7. The device according to claim 6, wherein at least one of the guide component, the guide member and the guide element comprises a solid wall.

8. The device according to claim 6, wherein the guide component is arranged at an angle to the guide element.

9. The device according to claim 4, wherein the separating device is attached below the magazine and pivotable around a horizontal axis.

10. The device according to claim 4, wherein the rear holder further includes a stop element to stop a front side of the stack as seen in the withdrawing direction.

* * * * *